United States Patent [19]

Akita et al.

[11] 4,286,862

[45] Sep. 1, 1981

[54] MEANS FOR SEPARATING A COPYING PAPER FROM A SENSITIVE BODY IN AN ELECTRONIC COPYING MACHINE

[75] Inventors: Yukio Akita; Hirotaka Izumi; Junichi Asano, all of Tokyo, Japan

[73] Assignee: Copyer Company Limited, Tokyo, Japan

[21] Appl. No.: 94,482

[22] Filed: Nov. 15, 1979

[30] Foreign Application Priority Data

Nov. 22, 1978 [JP] Japan ..... 53-143506

[51] Int. Cl.[3] ..... G03G 15/00

[52] U.S. Cl. ..... 355/3 SH; 271/DIG. 2; 361/235

[58] Field of Search ..... 323/4, 32, 41; 355/3 CH, 3 SH, 14 CH, 14 SH; 361/214, 235; 271/310, DIG. 2

[56] References Cited

U.S. PATENT DOCUMENTS

| | | | |
|---|---|---|---|
| 3,950,680 | 4/1976 | Michaels et al. | 355/14 CH |
| 4,183,653 | 1/1980 | Satomi et al. | 355/3 SH |
| 4,190,348 | 2/1980 | Friday | 361/235 X |

*Primary Examiner*—William M. Shoop
*Assistant Examiner*—Peter S. Wong
*Attorney, Agent, or Firm*—Thomas R. Morrison

[57] ABSTRACT

This invention relates to means of separating a copying paper from a sensitive body in an electronic copying machine, said means making it easy and sure to separate the former from the latter by controlling variably a voltage for removing electric charges by detecting variations of a differential current between the current flowing to an electrode of a charged device for copying, i.e. quantity of electric charges given to the copying paper and the current flowing to a shield case of the charged device.

1 Claim, 2 Drawing Figures

MEANS FOR SEPARATING A COPYING PAPER FROM A SENSITIVE BODY IN AN ELECTRONIC COPYING MACHINE

BACKGROUND OF THE INVENTION

This invention relates to means for separating a copying paper from a sensitive body in an electronic copying machine.

Referring to an example of a conventional electronic copying machine as shown in FIG. 1, a drum-type sensitive body 1 of which surface is made of a layer of a non-crystalline selenium or the like is rotated to a direction P as shown by arrow and charged uniformly by a Corona charged device 2. (The selenium layer has positive electricity.) Following to this, an image of an object (to be copied—not illustrated) which is placed on the sensitive drum 1 is projected on the sensitive drum 1 by exposure from a direction Q (light source). The projected image thereupon is developed by a developing means 3 using a magnetic brush or the like. The developed image is, as the sensitive drum 1 is further rotated, copied on a copying paper 4 which is fed at the same speed as synchronized with the rotation speed of the sensitive drum 1. The voltage of the copying paper 4 as well as of the sensitive drum 1 is decreased by a charged device 6 for removing electric charges, and the copied paper is fed to a final receiving place (not illustrated). On the other hand, the sensitive drum 1 is cleaned by a cleaning device 7, thereby any remaining image on the sensitive drum 1 is removed.

During the process of removing electric charges, that is, during the process of separating the copying paper 4 from the sensitive drum 1 by decreasing the voltage of the copying paper 4 and of the sensitive drum 1, a certain voltage removing electric charge is applied to the copying paper 4 by the charged device 6 for removing electric charges, so that there occurs a potential difference between the copying paper 4 and the sensitive drum 1. Then, electrostatic adsorption is caused therebetween, thereby separation of the former 1 from the latter 4 being difficult.

It is considered that this bad separation is caused by the following reason. In a typical example, it is now supposed that a superficial electric potential of +700 V is always applied to the sensitive drum 1 by Corona discharging of the Corona charged device 2. Then, the decrease of electric potential due to attenuation is not considered. In this case, the superficial electric potential on the surface of the sensitive drum 1 is varied in accordance with respective white portion and black portion of the object to be copied by projecting an image during the exposure process. Due to the exposure, the white portion remains +100 V and the black portion remains +700 V. Under this condition, the staticelectric invisible image on the sensitive drum 1 becomes a visible image by a developing process. Then, the electric potential on the surface of the sensitive drum 1 is attenuated by passing through the developing device 3, i.e. the white portion and the black portion are attenuated to 75 V and 420 V respectively. A visible image on the sensitive drum 1 is further rotated and passed over the charged device 5 in order to copy the visible image on the copying paper 4 which is fed at the same speed as synchronized with a rotation speed of the sensitive drum 1.

In this case, the superficial electric potential of the same polarity, that is, positive electric charges are applied to both the sensitive drum 1 and the copying paper 4 by means of the charged device 5 for copying. As a result, the visible image on the sensitive drum 1 is transferred to the copying paper 4.

A superficial electric potential on the sensitive drum 1 produces an important effect on separating the copying paper 4 from the sensitive drum 1. Based upon the aforementioned example, now 7,000 volts for copying is applied to the white portion and the black portion which have been already developed. In this case, the following data will be given.

| | Superficial electric potential before copying (Voltage) | Voltage of the charged device 5 for copying | Potential difference between the sensitive drum 1 and the charged device 5 (Voltage) |
|---|---|---|---|
| White portion | 75 | 7000 | 6925 |
| Black portion | 420 | 7000 | 6580 |

As shown above, the electric potential of the white portion is larger than that of the black portion. Accordingly, by applying 7,000 V from the charged device 5, the superficial electric potential of the copying paper 4 is changed as follows:

Superficial electric potential of the white portion
+395 V (320 V added to 75 V)

Superficial electric potential of the black portion
+610 V (190 V added to 420 V)

As understood obviously, the increase rate of the electric potential of the white portion is larger than that of the black portion.

When the copying paper 4 is fed over the charged device 6, an AC voltage for removing electric charges, for example, 5,000 V is applied to both the copying paper 4 and the sensitive drum 1 by means of the charged device 6 for removing electric charges. Since negative electric charges contribute to removing electric charges, the following data will be given.

| | AC Voltage for removing electric charges | Superficial Voltage of the sensitive drum 1 and copying paper 4 | Potential difference (V) between the sensitive drum 1 and the charged device 5 for copying |
|---|---|---|---|
| White portion | 5,000 | 395 | 5,395 |
| Black portion | 5,000 | 610 | 5,610 |

As obviously shown above, it is to be understood that the electric current (for removing electric charges) flows to the black portion easier than to the white portion. Therefore, there is the tendency that the electric-charges-removing quantity for the copying paper 4 is increased more than the quantity of electric charges. For the white portion, the electric-charges-removing quantity is inclined to be decreased than the quantity of electric charges.

Accordingly, when the same electric-charges-removing voltage as applied to the white portion is applied continuously to the black portion (in the above example an AC 5,000 Voltage for removing electric charges is applied), after a positive superficial electric potential of the sensitive drum 1 has been attenuated, an electric potential of reverse polarity (negative electric potential in this example) occurs and begins increasing. Then, an electrostatic adsorption between the copying paper 4 and the sensitive drum 1 is again started. This is a main cause a bad separation of the copying paper 4 from the sensitive drum 1.

BRIEF SUMMARY OF THE INVENTION

It is therefore an object of this invention to provide means for separating a copying paper from a sensitive body in an electronic copying machine, which makes it easy and sure to separate the former from the latter by controlling variably a voltage for removing electric charges by detecting variations of a differential current between the electric current flowing to an electrode of a charged device for copying, i.e. quantity of electric charges given to the copying paper and the electric current flowing to a shield case of the charged device.

Speaking more in detail, means for separating a copying paper from a sensitive drum in an electronic copying machine according to this invention comprises the following means:

(a) means for detecting electric current for copying, that is, means for detecting a differential current between electric current flowing to an electrode of a charged device for copying from a DC high voltage generator and electric current flowing to a shield case of said charged device for copying, (b) means for detecting electric current for removing electric charges, that is, means for detecting a differential current between electric current flowing to an electrode of a charged device for removing electric charges from an AC high voltage generator and electric current flowing to a shield case of said charged device, said electric current for removing electric charges being controlled to a setting rate in accordance with said differential current by said means for detecting said electric current for removing electric charges, (c) means for controlling electric current for removing electric charges by adding to said setting rate said differential current detected by said means for detecting said electric current for copying, whereby the controlled signals are fed to said AC high voltage generator, and (d) a delay circuit means transmitting signals of said differential current for copying to said AC high voltage generator by delaying a distance between said first electrode for copying and said second electrode for removing electric charges.

BRIEF DESCRIPTION OF THE ACCOMPANYING DRAWING

DETAILED DESCRIPTION OF THE INVENTION

Figure 1:
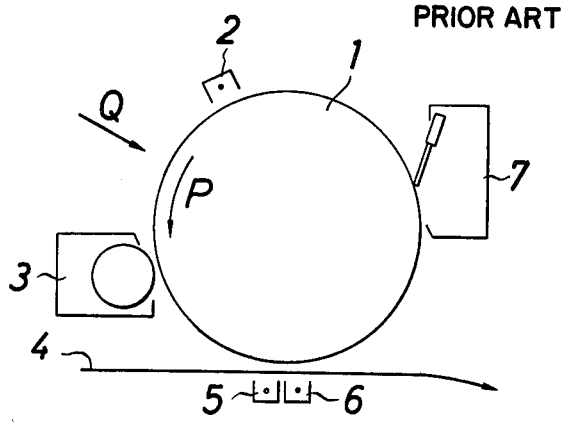
FIG. 1 is a side view of a main section of a conventional electronic copying machine.
Figure 2:
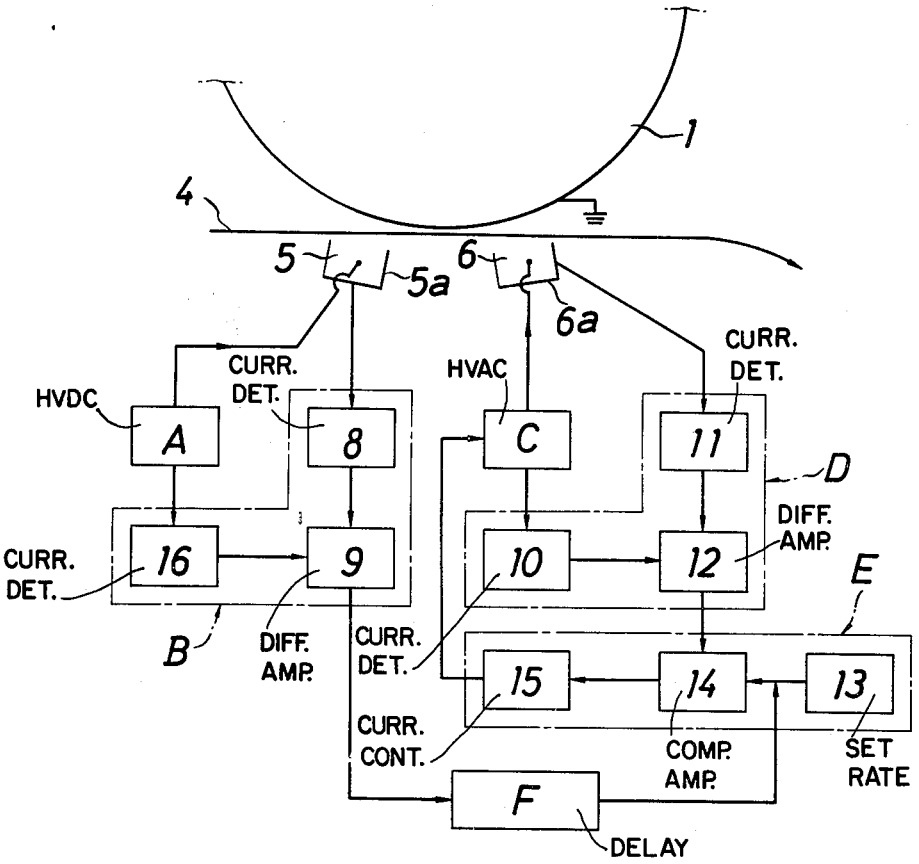
FIG. 2 is a view of a main section and its block diagram of an electronic copying machine according to this invention, in which a copying paper is separated from a sensitive drum.

A preferred example of this invention will now be described in connection with FIG. 2.

Numeral 1 is a sensitive drum in an electronic copying machine. Numeral 4 is a copying paper which is being fed under the sensitive drum 1. Symbol A is a DC high voltage generator for applying a DC voltage to a charged device 5 for copying. The charged device 5 is shielded by a shield case 5*a*. Symbol B is an electric current detecting means which comprises a circuit 16 for detecting current flowing to an electrode of the charged device 5, a circuit 8 for detecting current flowing to the shield case 5*a* and a differential amplifying circuit 9 for detecting a differential current (for copying) between the aforegoing two detected currents. Symbol C is an AC high voltage generator for applying an AC high voltage to a charged device 6 for removing electric charges. The charged device 6 is shielded by a shield case 6*a*. Symbol D is means for detecting electric current for removing electric charges, which comprises a circuit 10 for detecting current flowing to an electrode of the charged device 6 for removing electric charges, a circuit 11 for detecting current flowing to the shield case 6*a* and a differential amplifying circuit 12 for detecting a differential current (for removing electric charges) between the aforegoing two detected currents. Symbol E is means for controlling electric current for removing electric charges, which controls always to a setting rate 13 the current for removing electric charges in comparing with a difference between the signals controlled by the differential current (for removing electric charges) and the setting rate 13, further controls the current for removing electric charges by adding the differential current for copying to the setting rate, and still further transmits the controlled signals to the AC high voltage generator C. Numeral 14 is a comparative amplifying circuit for amplifying and reading comparatively a differential current between the current of the setting rate 13, the current of the amplifying circuit 12 and the current of a delay circuit means F which will be described hereinafter.

Numeral 15 is a positive/negative current control circuit which transmits signals controlled by the comparative amplifying circuit 14 to the AC high voltage generator C.

The setting rate 13 is a standard one for defining, for instance, 5 KV (for removing electric charges) for the reading current 10 μA. If the reading rate is more than the standard rate, it is necessary to reduce the positive/-negative current. If the reading rate is less than the standard rate, it is necessary to increase the positive/-negative current. Symbol F is the delay circuit means which transmit signals of the differential electric current for copying to the AC high voltage generator C by delaying a time corresponding to the time for a point on sensitive drum 1 to travel a distance between a first electrode for copying and a second electrode for removing electric charges.

A function of means for separating a copying paper from a sensitive drum in an electronic copying machine according to this invention will now be described.

A differential current between the current flowing to the shield case 5*a* of the charged device 5 for copying and the current flowing to an electrode of the charged device 5 from the DC high voltage generator A is detected by the means B for detecting current for copying. (The differential current is variable in accordance with the black portion of and the white portion respectively of the object to be copied.) On the other hand, a differential current between the current flowing to the shield case 6*a* of the charged device 6 for removing electric charges and the current flowing to the electrode of the charged device 6 from the DC high voltage generator C is detected by the means D for removing electric charges. Since the current flowing to the electrode for removing electric charges is an Alternating Current, the current flowing in both a positive direction and a negative direction is detected, that is, the differential current in a positive direction and the differential current in a negative direction are obtained. Namely, the means E for controlling current removing electric charges controls to the setting rate 13 the current for removing electric charges in comparing the detected positive/-negative differential currents with the setting rate 13.

Following this, the signals of the differential current for copying which were detected by the means B for detecting current for copying are fed to the means E for controlling current for removing electric charges. And its differential current is added to the setting rate 13, thereby the current for removing electric charges being controlled and set. The controlled signals are fed to the AC high voltage generator C, thereby a properly controlled current for removing electric charges is applied to the charged device 6 for removing electric charges.

However, since the signals of the differential current for copying are effective at the first electrode for copying which is spaced a fixed distance from the second electrode for removing electric charges, it becomes necessary to provide the delay circuit means F for delaying transmission of the above signals while a point on the sensitive drum 1 moves this distance as mentioned above.

Now, an example without having the delay circuit means will be described hereinafter.

For instance, assume that the image of an object such as a printing paper is projected on the sensitive drum 1 which thus has a thin white and black image portion formed at right angles to the advancing direction of the copying paper 4. And assume that the white portion of the copying paper 4 is firstly detected by the electric current for copying, and the detected signals are added to the setting rate 13. Then, a positive/negative differential current of the current for removing electric charges is increased more than the setting rate 13. However, an end of the copying paper 4 is not reaching the electrode of the charged device 6 for removing electric charges. If it comes on the electrode for removing electric charges after a slight time lag, the then current for copying is equivalent to the current of either white portion or black portion which is distant from the first electrode for copying to the second electrode for removing electric charges.

If the black portion is detected by the current for copying and the white portion is detected by the current for removing electric charges, then the current for removing electric charges is controlled by the current for copying, and a differential current most suitable for the black portion is applied to the white portion. Then, the current for removing electric charges for the white portion of the copying paper 4 is less than the quantity of the electric charges, consequently separation of the copying paper 4 from the sensitive drum 1 is difficult. In order to avoid this bad separation, it is needed to provide the delay circuit means F for transmitting controlled signals of the electrode for copying to the AC high voltage generator C by delaying a distance between the first electrode for copying and the second electrode for removing electric charges. This is one of the most remarkable features of this invention.

As described above, according to this invention, by detecting a differential current between the electric current flowing to the electrode of the charged device for copying and the electric current flowing to the shield case of the charged device for copying, the electric current for removing electric charges can be controlled variably, so that it becomes easy and sure to separate the copying paper from the sensitive drum.

What is claimed is:

1. Means for separating a copying paper from a sensitive body in an electronic copying machine comprising:

(a) means for detecting electric current for copying, said means for detecting a differential current between electric current flowing to a first electrode of a charged device for copying from a DC high voltage generator and electric current flowing to a shield case of said charged device for copying, (b) means for detecting electric current for removing electric charges, said means for detecting a differential current between electric current flowing to a second electrode of a charged device for removing electric charges from an AC high voltage generator and electric current flowing to a shield case of said charged device, said electric current for removing electric charges being controlled to a setting rate in accordance with said differential current detected by said means for detecting said electric current for removing electric charges, (c) means for controlling electric current for removing electric charges by adding to said setting rate said differential current detected by said means for detecting said electric current for copying, whereby the controlled signals are fed to said AC high voltage generator, and (d) a delay circuit means transmitting signals of said differential current for copying to said AC high voltage generator by delaying said signals for a time corresponding to a time for a point on said sensitive body to move a distance between said first electrode for copying and said second electrode for removing electric charges.

* * * * *